US011980995B2

(12) United States Patent
Li

(10) Patent No.: US 11,980,995 B2
(45) Date of Patent: May 14, 2024

(54) MOTOR TORQUE ENDPOINT DURING POLISHING WITH SPATIAL RESOLUTION

(71) Applicant: Applied Materials, Inc., Santa Clara, CA (US)

(72) Inventor: Thomas Li, Santa Clara, CA (US)

(73) Assignee: Applied Materials, Inc., Santa Clara, CA (US)

( * ) Notice: Subject to any disclaimer, the term of this patent is extended or adjusted under 35 U.S.C. 154(b) by 95 days.

(21) Appl. No.: 17/674,757

(22) Filed: Feb. 17, 2022

(65) Prior Publication Data

US 2022/0281066 A1 Sep. 8, 2022

Related U.S. Application Data

(60) Provisional application No. 63/156,302, filed on Mar. 3, 2021.

(51) Int. Cl.
*B24B 49/16* (2006.01)
*B24B 7/22* (2006.01)
(Continued)

(52) U.S. Cl.
CPC ..... *B24B 49/16* (2013.01); *B24B 7/228* (2013.01); *B24B 37/013* (2013.01);
(Continued)

(58) Field of Classification Search
CPC ..... B24B 7/228; B24B 37/04; B24B 37/042; B24B 37/10; B24B 37/105; B24B 37/107
See application file for complete search history.

(56) References Cited

U.S. PATENT DOCUMENTS 5,069,002 A * 12/1991 Sandhu ..... B24B 37/013 438/959
5,445,996 A * 8/1995 Kodera ..... B24B 49/00 257/E21.243

(Continued)

FOREIGN PATENT DOCUMENTS

CN 102390036 3/2012
JP 2014-003063 1/2014
WO WO-2021181944 A1 * 9/2021 ..... B24B 37/042

OTHER PUBLICATIONS

International Search Report and Written Opinion in International Appln. No. PCT/US2022/016857, dated May 30, 2022, 11 pages.

*Primary Examiner* — Steven M Cernoch
*Assistant Examiner* — Jonathan R Zaworski
(74) *Attorney, Agent, or Firm* — Fish & Richardson P.C.

(57) ABSTRACT

During polishing of a substrate a sequence of measured values is received from an in-situ motor torque monitoring system. Positions on the substrate of the region of lower coefficient of friction are calculated for at least two measured values from the sequence of measured values. A first measured value from the sequence of measured values at which the region of different coefficient of friction is at a first position in a first zone on the substrate is compared to a second measured value from the sequence of measured values at which the region of different coefficient of friction is at a second position in a different second zone on the substrate or is not below the substrate. Based on the comparison, which of the first zone or the second zone the overlying layer is clearing first to expose the underlying layer can be determined.

19 Claims, 3 Drawing Sheets

(51) Int. Cl.

| | |
|---|---|
| ***B24B 37/013*** | (2012.01) |
| ***B24B 37/04*** | (2012.01) |
| ***B24B 37/24*** | (2012.01) |
| ***B24B 49/04*** | (2006.01) |

(52) U.S. Cl.
CPC ..... *B24B 37/042* (2013.01); *B24B 37/24* (2013.01); *B24B 49/04* (2013.01)

(56) References Cited

U.S. PATENT DOCUMENTS 6,231,425 B1 5/2001 Shoichi et al.
6,458,013 B1 * 10/2002 Saka ..... B24B 37/042 451/41
6,641,463 B1 * 11/2003 Molnar ..... B24D 3/28 451/60
6,872,662 B1 3/2005 Hocheng et al.
6,986,698 B1 * 1/2006 Molnar ..... B24B 37/013 702/182
7,513,818 B2 * 4/2009 Miller ..... B24B 37/042 451/28
8,096,852 B2 * 1/2012 Deshpande ..... B24B 49/18 451/72
8,342,906 B2 * 1/2013 Miller ..... B24B 37/013 451/5
9,278,424 B2 * 3/2016 Roy ..... B24D 11/04
10,220,487 B2 * 3/2019 Roy ..... B24B 37/26
10,898,986 B2 1/2021 Lee et al.
11,679,469 B2 * 6/2023 Yen ..... B24B 37/24 438/5
2002/0037681 A1 * 3/2002 Gitis ..... G01B 17/08 451/287
2002/0090889 A1 7/2002 Crevasse et al.
2004/0259470 A1 12/2004 Swedek et al.
2005/0136800 A1 * 6/2005 Miller ..... B24B 37/013 451/41
2005/0260922 A1 11/2005 Gan et al.
2007/0087662 A1 4/2007 Benvegnu et al.
2008/0014839 A1 1/2008 Pietsch et al.
2009/0011679 A1 1/2009 Bajaj et al.
2013/0189801 A1 * 7/2013 Molnar ..... H01L 22/12 438/8
2013/0288572 A1 10/2013 Benvegnu
2013/0337586 A1 12/2013 Iizumi et al.
2015/0371913 A1 * 12/2015 Lu ..... H01L 22/14 438/11
2017/0252889 A1 * 9/2017 Watanabe ..... B24B 49/16
2018/0079048 A1 3/2018 Shin-haur et al.
2020/0070306 A1 3/2020 Wiswell et al.

* cited by examiner

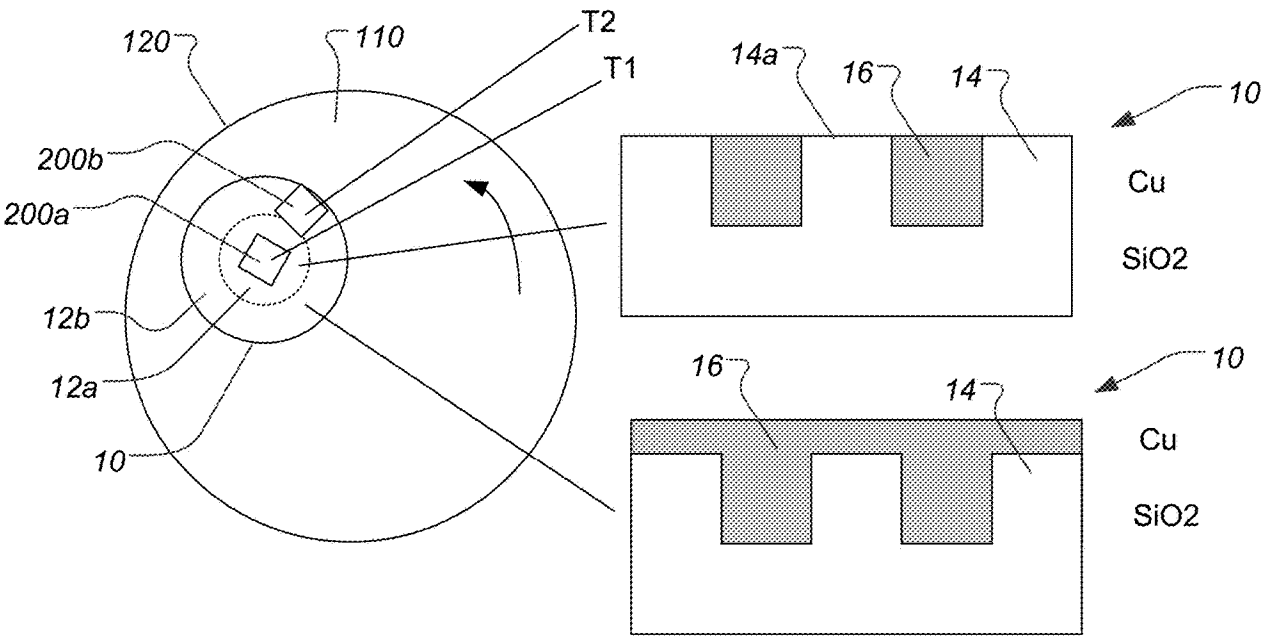

FIG. 4

| Motor torque | | | |
|---|---|---|---|
| | | T2>T1 | T2<T1 |
| Underlying layer has lower coefficient of friction than upper layer | Region has lower coefficient of friction than polishing surface | Center cleared first | Edge cleared first |
| | Region has higher coefficient of friction than polishing surface | Edge cleared first | Center cleared first |
| Underlying layer has higher coefficient of friction than upper layer | Region has lower coefficient of friction than polishing surface | Edge cleared first | Center cleared first |
| | Region has higher coefficient of friction than polishing surface | Center cleared first | Edge cleared first |

FIG. 5

MOTOR TORQUE ENDPOINT DURING POLISHING WITH SPATIAL RESOLUTION

CROSS-REFERENCE TO RELATED APPLICATIONS

This application claims priority to U.S. Provisional Application Ser. No. 63/156,302, filed on Mar. 3, 2021, the disclosure of which is incorporated by reference.

TECHNICAL FIELD

This disclosure relates to using monitoring of motor torque or motor current during chemical mechanical polishing.

BACKGROUND

An integrated circuit is typically formed on a substrate by the sequential deposition of conductive, semiconductive, or insulative layers on a silicon wafer. One fabrication step involves depositing a filler layer over a non-planar surface and planarizing the filler layer. For certain applications, the filler layer is planarized until the top surface of a patterned layer is exposed. A conductive filler layer, for example, can be deposited on a patterned insulative layer to fill the trenches or holes in the insulative layer. After planarization, the portions of the metallic layer remaining between the raised pattern of the insulative layer form vias, plugs, and lines that provide conductive paths between thin film circuits on the substrate. For other applications, such as oxide polishing, the filler layer is planarized until a predetermined thickness is left over the non planar surface. In addition, planarization of the substrate surface is usually required for photolithography.

Chemical mechanical polishing (CMP) is one accepted method of planarization. This planarization method typically requires that the substrate be mounted on a carrier or polishing head. The exposed surface of the substrate is typically placed against a rotating polishing pad. The carrier head provides a controllable load on the substrate to push it against the polishing pad. An abrasive polishing slurry is typically supplied to the surface of the polishing pad.

One problem in CMP is determining whether the polishing process is complete, i.e., whether a substrate layer has been planarized to a desired flatness or thickness, or when a desired amount of material has been removed. Variations in the slurry distribution, the polishing pad condition, the relative speed between the polishing pad and the substrate, and the load on the substrate can cause variations in the material removal rate. These variations, as well as variations in the initial thickness of the substrate layer, cause variations in the time needed to reach the polishing endpoint. Therefore, the polishing endpoint usually cannot be determined merely as a function of polishing time.

In some systems, the substrate is monitored in-situ during polishing, e.g., by monitoring the torque or current required by a motor to rotate the platen or carrier head. However, existing monitoring techniques may not satisfy increasing demands of semiconductor device manufacturers.

SUMMARY

In one aspect, a method of polishing includes bringing a substrate into contact with a polishing pad that has a polishing surface and a region of different coefficient of friction than the polishing surface, generating relative motion between the substrate and polishing pad such that the region of lower coefficient of friction moves across the substrate, during polishing of the substrate monitoring the substrate with an in-situ motor torque monitoring system to generate a sequence of measured values, calculating positions on the substrate of the region of lower coefficient of friction for at least two measured values from the sequence of measured values, comparing a first measured value from the sequence of measured values at which the region of different coefficient of friction is at a first position in a first zone on the substrate to a second measured value from the sequence of measured values at which the region of different coefficient of friction is at a second position in a different second zone on the substrate or is not below the substrate, based on comparing the first measured value and the second measured value, determining in which of the first zone or the second zone the overlying layer is clearing first to expose the underlying layer, and adjusting a polishing parameter based on which of the first zone or the second zone is clearing first.

In another aspect, a non-transitory computer-readable medium has stored thereon instructions, which, when executed by a processor, causes the processor to perform operations of the above method.

Implementations can include one or more of the following potential advantages. Spatial information concerning the relative coefficient of friction of the substrate on the polishing pad can be extracted from the motor torque signal. Polishing can be halted more reliably for the entire substrate at exposure of an underlying layer. Polishing uniformity can be increased, and both dishing and residue can be reduced.

The details of one or more embodiments are set forth in the accompanying drawings and the description below. Other aspects, features and advantages will be apparent from the description and drawings, and from the claims.

DESCRIPTION OF DRAWINGS

FIG. 4 illustrates a schematic of a recess in the polishing pad passing below different regions of the substrate having different degrees of polishing.

FIG. 5 illustrates logic chart for determining a region of the substrate that is being cleared.

Like reference symbols in the various drawings indicate like elements.

DETAILED DESCRIPTION

In some semiconductor chip fabrication processes an overlying layer, e.g., silicon oxide or polysilicon, is polished until an underlying layer, e.g., a dielectric, such as silicon oxide, silicon nitride or a high-K dielectric, is exposed. For many applications, the underlying layer has a different coefficient of friction against the polishing layer than the overlying layer. As a result, when the underlying layer is exposed, the torque required by a motor to cause the platen or carrier head to rotate at a specified rotation rate changes. The polishing endpoint can be determined by detecting this change in motor torque. Motor torque can be measured by measuring the motor's power consumption, e.g., by measuring motor current if voltage is held constant. Alternatively, a strain gauge cam be attached to the carrier head drive shaft or to an internal spindle inside the carrier head to monitor frictional force on the carrier head.

Most polishing processes resulting in different polishing rates across the substrate, so that the underlying layer is cleared at the substrate edges before the center, or vice versa. Unfortunately, in conventional motor torque monitoring techniques, the torque is a result of the total frictional force across the entire wafer surface; there is no spatial resolution for the measurement. Consequently, when underlying layer is beginning to be exposed in some regions of the substrate and the motor current signal begins to change, it is not possible to determine which portion of the substrate is being clearing first.

However, the polishing pad can be provided with a region with a different coefficient of friction than the remainder of the polishing surface of the polishing pad. The position of this region can be tracked as the region moves across the substrate. For example, the region can have a lower coefficient of friction, e.g., be provided by an aperture with no friction. Alternatively, the region can have a higher coefficient of friction. By comparing motor torque signals from times when the region is below different positions on the substrate, information can be obtained regarding the spatial distribution of clearing on the substrate.

Figure 1:
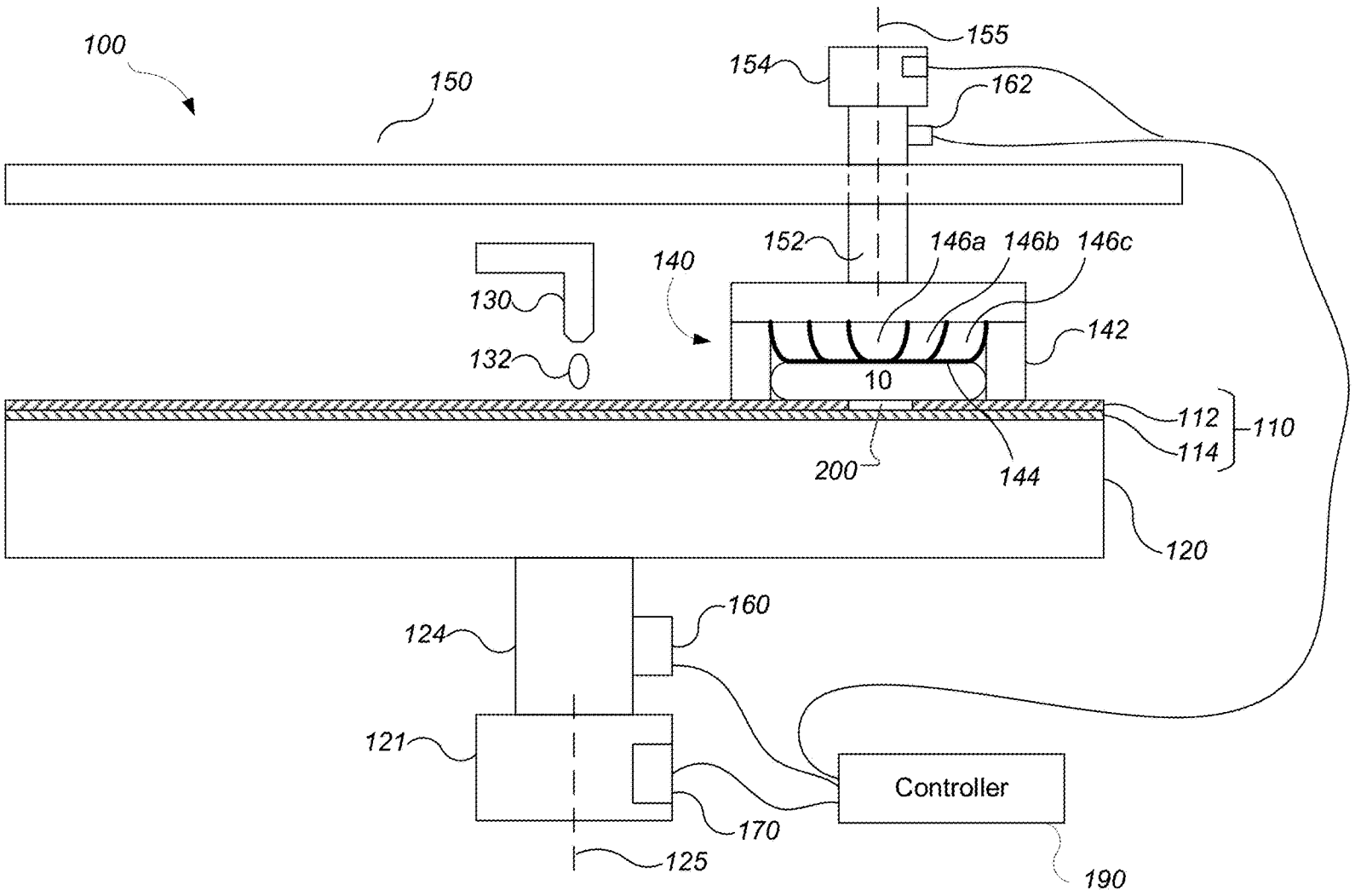
FIG. 1 illustrates a schematic cross-sectional view of an example of a polishing apparatus.

FIG. 1 illustrates an example of a polishing apparatus 100. The polishing apparatus 100 includes a rotatable disk-shaped platen 120 on which a polishing pad 110 is situated. The polishing pad 110 can be a two-layer polishing pad with an outer polishing layer 112 and a softer backing layer 114.

Figure 2A:
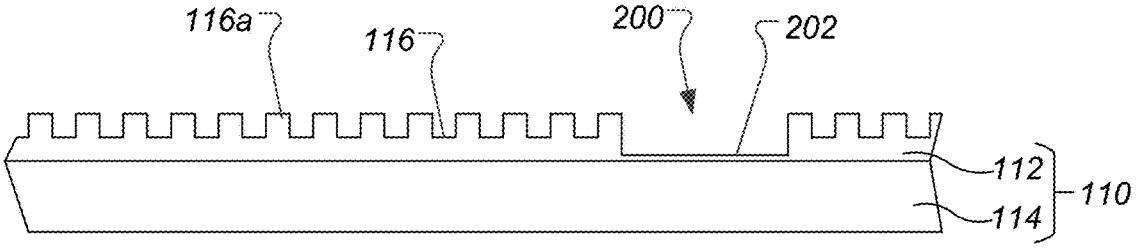
FIG. 2A illustrates a schematic cross-sectional view of a polishing pad.

As shown in FIG. 2A, a plurality of grooves 116 are formed in the polishing surface of the polishing layer 112. The grooves 116 can be distributed with uniform density and spacing across the polishing surface. In general, the grooves are distributed with a sufficiently high density that relative motion between the substrate and the polishing pad that the presence of the grooves does not induce changes to the frictional coefficient between substrate and polishing surface.

The grooves 116 can be concentric circular grooves, a rectangular cross-hatched pattern, a hexagonal pattern, etc. The grooves 116 can be 10 to 40 mils wide. Partition 116*a* between the grooves 116 can be 50 to 200 mils wide. Accordingly, the pitch between the grooves may be between about 60 to 240 mils. 0.09 and 0.24 inches. The ratio of groove width to partition width may be selected to be between about 0.10 and 0.25.

The grooves 116 can have a depth of 15 to 50 mils. The polishing layer 112 can have a thickness between about 60 and 120 mils. The depth of the grooves 116 can be selected so that the distance between the bottom of a groove and the top of the backing layer 114 is 35 to 85 mils.

Figure 2B:
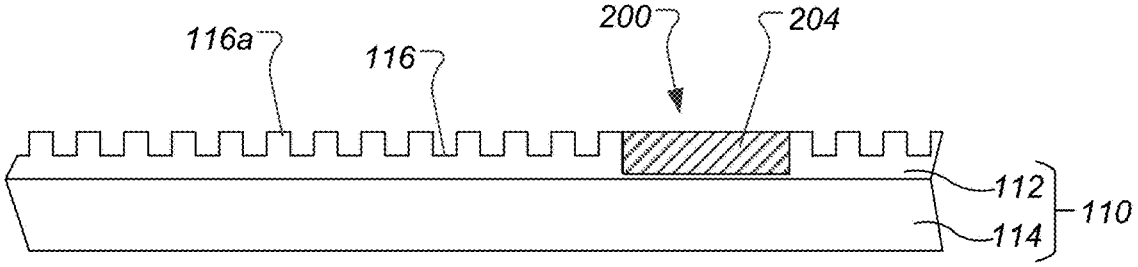
FIG. 2B illustrates a schematic cross-sectional view of another implementation of a polishing pad.

In addition to the grooves 116, the polishing pad is provided with a region 200 having a different coefficient of friction than the remainder of the polishing pad (e.g., the region with the grooves 116). As shown in FIG. 2A, the region 200 can be provided by a recess 202. In this case the region 200 has a lower coefficient of friction (as no polishing material is present to provide frictional force). Alternatively, as shown in FIG. 2B, the region 200 can be provided by an insert 204 that has a top surface coplanar with the polishing surface.

In some implementations the insert 204 is formed of a material that has a lower coefficient of friction with the substrate 10 than the remainder of the polishing pad, e.g., a non-stick material such as polytetrafluoroethylene (PTFE). Alternatively or in addition, a region with wider grooves and/or more closely spaced apart grooves can provide a lower coefficient of friction. In some implementations, the insert 204 is formed of a material that has a higher coefficient of friction with the substrate 10 than the remainder of the polishing pad. Alternatively or in addition, a region with narrower grooves and/or more widely spaced apart grooves can provide a higher coefficient of friction.

In some implementations, the insert has a different groove pattern. For example, a pad that is primarily concentric circular grooves, the region 200 could have XY groove pattern (sets of grooves running perpendicular to form rectangular posts). In some implementations, the region 200 can be the same material but be manufactured with a different porosity. In addition, the region 200 can have different groove depth than the polishing surface.

Unlike the grooves 116 which are distributed such that relative motion between the substrate and the polishing pad does not induce measureable changes to the frictional coefficient between substrate and polishing surface, the region 200 is sufficiently large to induce a measureable changes to the frictional coefficient. Moreover, unlike the grooves 116 which are distributed to have uniform density angularly about the axis of rotation of the platen 120, the region 200 is discrete and angularly limited (see FIG. 3). For example, for a 300 mm diameter substrate, the region can be about 30-60 mm across. The region can be circular, square, hexagonal, etc.

Returning to FIG. 1, the platen 120 is operable to rotate about an axis 125. For example, a motor 121, e.g., a DC induction motor, can turn a drive shaft 124 to rotate the platen 120.

The polishing apparatus 100 can include a port 130 to dispense polishing liquid 132, such as abrasive slurry, onto the polishing pad 110 to the pad. The polishing apparatus can also include a polishing pad conditioner to abrade the polishing pad 110 to maintain the polishing pad 110 in a consistent abrasive state.

The polishing apparatus 100 includes at least one carrier head 140. The carrier head 140 is operable to hold a substrate 10 against the polishing pad 110. Each carrier head 140 can have independent control of the polishing parameters, for example pressure, associated with each respective substrate.

The carrier head 140 can include a retaining ring 142 to retain the substrate 10 below a flexible membrane 144. The carrier head 140 also includes one or more independently controllable pressurizable chambers defined by the membrane, e.g., three chambers 146*a*-146*c*, which can apply independently controllable pressurizes to associated zones on the flexible membrane 144 and thus on the substrate 10. Although only three chambers are illustrated in FIG. 1 for ease of illustration, there could be one or two chambers, or four or more chambers, e.g., five chambers.

The carrier head 140 is suspended from a support structure 150, e.g., a carousel, and is connected by a drive shaft 152 to a carrier head rotation motor 154, e.g., a DC induction motor, so that the carrier head can rotate about an axis 155. Optionally each carrier head 140 can oscillate laterally, e.g., on sliders on the carousel 150, or by rotational oscillation of the carousel itself. In typical operation, the platen is rotated about its central axis 125, and each carrier head is rotated about its central axis 155 and translated laterally across the top surface of the polishing pad.

A controller 190 (which can also be called a control system), such as a programmable computer, is connected to the motors 121, 154 to control the rotation rate of the platen 120 and carrier head 140. For example, each motor can include an encoder that measures the rotation rate of the associated drive shaft. A feedback control circuit, which could be in the motor itself, part of the controller, or a separate circuit, receives the measured rotation rate from the encoder and adjusts the current supplied to the motor to ensure that the rotation rate of the drive shaft matches at a rotation rate received from the controller.

The polishing apparatus 100 can also include a position sensor 196, such as an optical interrupter, to sense when the region 200 is underneath the substrate 10 and when the region 200 is off the substrate. For example, the position sensor 196 can be mounted at a fixed location opposite the carrier head 140. A flag 198 can be attached to the periphery of the platen 120. The point of attachment and length of the flag 198 is selected so that it can signal the position sensor 196 when the region 200 sweeps underneath the substrate 10.

Alternately or in addition, the polishing apparatus 100 can include an encoder to determine the angular position of the platen 120.

The polishing apparatus also includes an in-situ monitoring system 160, e.g., a motor current or motor torque monitoring system, which can be used to determine a polishing endpoint. The in-situ monitoring system 160 includes a sensor to measure a motor torque and/or a current supplied to a motor.

For example, a torque meter 160 can be placed on the drive shaft 124 and/or a torque meter 162 can be placed on the drive shaft 152. The output signal of the torque meter 160 and/or 162 is directed to the controller 190.

Alternatively or in addition, a current sensor 170 can monitor the current supplied to the motor 121 and/or a current sensor 172 can monitor the current supplied to the motor 154. The output signal of the current sensor 170 and/or 172 is directed to the controller 190. Although the current sensor is illustrated as part of the motor, the current sensor could be part of the controller (if the controller itself outputs the drive current for the motors) or a separate circuit.

The output of the sensor can be a digital electronic signal (if the output of the sensor is an analog signal then it can be converted to a digital signal by an ADC in the sensor or the controller). The digital signal is composed of a sequence of signal values, with the time period between signal values depending on the sampling frequency of the sensor. The sampling frequency can be 100 Hz to 10 kHz, e.g., 200 Hz.

This sequence of signal values resulting from sampling by the sensor can be referred to as a signal-versus-time curve. The sequence of signal values can be expressed as a set of values xn. The "raw" digital signal from the sensor can be smoothed using a filter, e.g., a filter that incorporates linear prediction.

Figure 3:
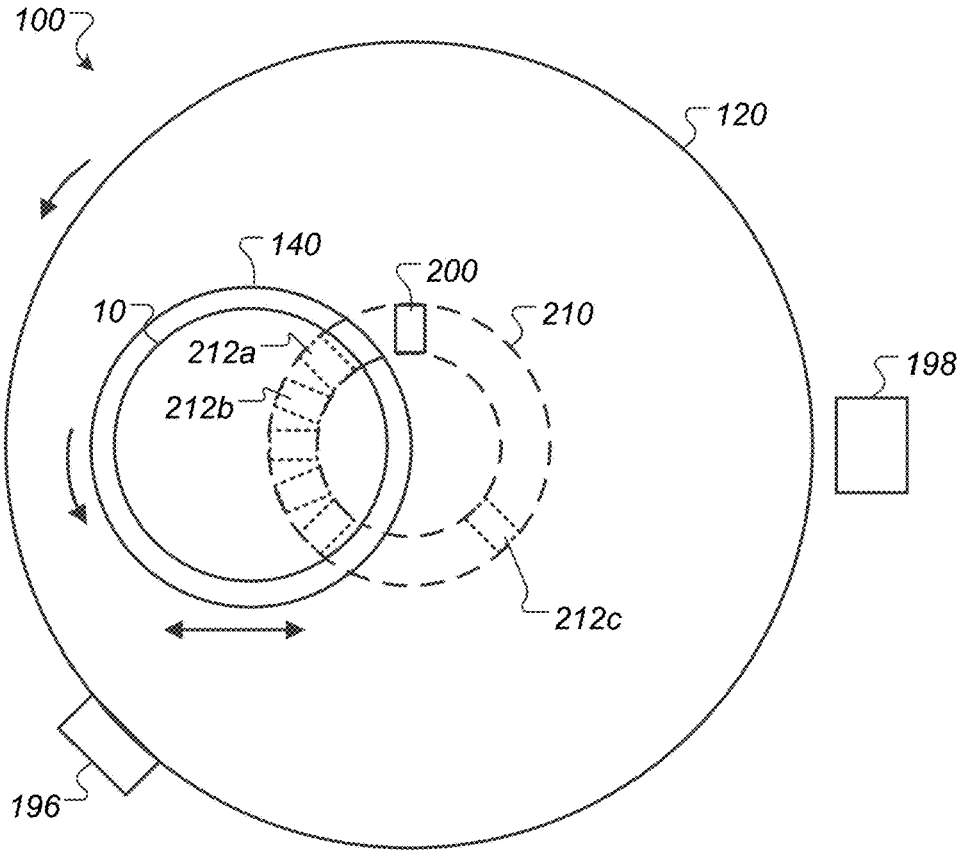
FIG. 3 illustrates a schematic top view of an example of a polishing apparatus.

Referring now to FIG. 3, because the polishing pad 110 is moving relative to the substrate 10, e.g., the platen 120 is rotating, the region 200 will travel along a circular path 210, a portion of which sweeps below the substrate 10. Due to the sampling frequency of the motor torque sensor, each measurement can occur with the region 200 at a different position, e.g., positions 212*a*, 212*b*, etc., below the substrate 10. In addition, some measurements are taken when the region 200 is not below the substrate 10, e.g., at position 212*c*.

For measurements made when the region 200 is below the substrate 10, the radial position of the region 200 relative to the axis of rotation 155 or center of the substrate 10 can be determined, e.g., from the signal from the position sensor 196, motor encoder, timing of measurements, and known dimensions of the components. This permits each torque measurement to be assigned to a portion of the substrate. An example of a technique for determining the radial position of a sensor is described in U.S. Pat. No. 10,898,986, and this could be adapted to determine the position of the region 200 rather than the sensor.

Based on the sequence of signal values from the sensor, plus information on the position of the region 200 for each measured signal value, it is possible to determine whether certain regions of the substrate are being cleared before other regions.

As an explanatory example, FIG. 4 illustrates a substrate 10 being polished in which a central portion 12*a* of the substrate 10 has been cleared, i.e., a filler material has been polished until the top surface 14*a* of a pattern underlying layer 14 has been exposed, leaving the filler material 16 in the trenches. For example, the filler material can be metal, such as copper, and the underlying layer can be a dielectric, such as silicon oxide. In contrast, an outer annular portion 12*b* of the substrate 10 has not been cleared, i.e., the filler material 16 remains over the pattern of the underlying layer 14.

Due to the different compositions of the filler material 16 and underlying layer 14, the filler material 16 and underlying layer 14 will have different coefficients of friction against the polishing pad. Supposing that the region 200 is a recess, when the recess is below the substrate the load will be reapplied across the remainder the substrate 10. Thus, the motor torque should remain generally constant regardless of whether the region 200 is below passes below the substrate 10. If the region 200 is a solid body with a lower coefficient of friction than the remainder of the surface of the polishing pad 110, then motor torque should drop when the region 200 passes below the substrate 10. On the other hand, if the region 200 is a solid body with a higher coefficient of friction than the remainder of the surface of the polishing pad 110, then motor torque should increase when the region 200 passes below the substrate 10.

In any of these case, if the substrate 10 is only partially cleared, e.g., cleared in only the center portion 12*a* or outer portion 12*b*, the motor torque signal will vary depending on whether the region 200 is below the center portion 12*a* (shown by 200*a*), or below the outer portion 12*b* (shown by 200*b*) of the substrate 10. Suppose that the underlying layer 14 has a lower coefficient of friction than the filler material 16, that the center portion 12*a* clears first, and the region 200 is provided by a recess. In this case, when the region 200 is at position 200*b*, a portion of the substrate having a higher coefficient of friction is not contributing to the total torque, whereas when the region is at position 200*a*, a portion of the substrate having a lower coefficient of friction is not contributing to the total torque. As a result, the torque signal T2 when the region 200 is below the outer portion 12*b* of the substrate should be higher than the torque signal T1 when the region 200 is below the inner portion 12*a* of the substrate.

The controller 190 can compare the two torque signals T1 and T2. If T2 is greater than T1, this can indicate that the center portion 12*a* is cleared first, whereas if T1 is greater than T2, this can indicate that the outer portion 12*b* is cleared first. Depending on which portion clears first, the controller 190 can control the polishing head 140 to reduce pressure on that portion so as to avoid overpolishing, dishing or erosion.

More generally, if the relative magnitude of the coefficient of friction of region 200 versus the remainder of the polishing pad 110 is known (e.g., higher or lower), and the relative coefficient of friction of the underlying material 14 and the filler material 16 is known region (e.g., higher or lower), then the controller 90 can determine which portion of the substrate has cleared based on a comparison of the torque signals generated when the region 200 is below the respective portions. FIG. 5 illustrates a theoretical logic chart for determining which portion of the substrate clears first based on the relative coefficients of friction and the signals from the in-situ torque monitoring system.

Alternatively, the portion of the substrate that clears can be determined on the basis of the change in motor torque for each material when the region 200 passes below that region relative to the region 200 not being below the substrate at all. These relationships can be determined empirically. By comparing the motor torque signals from the various regions, which region of the substrate has been exposed can be determined.

For example, assume the filler material 16 has a large drop in friction when going from the polishing surface to the region 200, and the underlying material 14 has a smaller effect. In this case, the motor torque will be highest when the region 200 is not under the wafer/head at all, the motor torque will be lower when the region 200 is contacting the underlying material 14, and the motor torque will be lowest when the region 200 is contacting the filler material 16. As another example, assume the filler material 16 has a small drop in friction when going from the polishing surface to the region 200, and the underlying material 14 has a larger effect. In this case, the motor torque will be highest when the region 200 is not under the wafer/head at all, the motor torque will be lower when the region 200 is contacting the filler material 16, and the motor torque will be lowest when the region 200 is contacting the underlying material 14. As another example, assume the filler material 16 has an increase in friction when going from the polishing surface to the region 200, and the underlying material 14 has a decrease in friction. In this case, the motor torque will be highest when the region 200 is contacting the filler material 16, the motor torque will be lower when the region 200 is not under the wafer/head at all, and the motor torque will be lowest when the region 200 is contacting the underlying material 14. As another example, assume the filler material 16 has a decrease in friction when going from the polishing surface to the region 200, and the underlying material 14 has an increase. In this case, the motor torque will be highest when the region 200 is below the underlying material 14, the motor torque will be lower when the region 200 is not under the wafer/head at all, and the motor torque will be lowest when the region 200 is contacting the filler material 16.

Alternatively, the motor torque signal profile (e.g., motor torque as a function of the position of the region 200 below the substrate) can be monitored over time. In an idealization, during bulk polishing and before the underlying layer is exposed the same material is being polished across the substrate and thus the motor torque profile should be substantially uniform regardless of the position of the region 200. However, as the underlying layer is exposed, the position of the region 200 will affect the torque signal. Thus, those portions of the substrate for which the motor torque signal profile changes can be identified as clearing.

Although the discussion above focuses on two portions of the substrate, these principles can be applied for three or more portions of the substrate. In addition, although FIG. 4 illustrates the portions as a circular central portion 12*a* and a concentric annular portion 12*b*, if the angular position of the region 200 relative to the axis of rotation of the carrier head 140 can be calculated, then the regions can be distributed angularly around the axis of rotation rather than being circular or annular.

Another issue is that there can be extraneous cyclic "noise" in the torque motor signal, e.g., due to rotation and sweep of the carrier head, and rotation and sweep of the pad conditioner. A filter, e.g., a band stop filter or a Kalman filter to can be used to filter out the cyclic noise without filtering out the actual signal. In particular, the filter can be a band stop filter that blocks frequencies corresponding to the frequency of rotation and sweep of the carrier head and conditioner.

In order to determine the frequencies to be blocked, the torque signal can be monitored for an initial time period that ends before any expected exposure of the underlying layer. This time period can be empirically determined, e.g., if most polishing operations take 2-3 minutes, the initial time period could be 60-90 seconds. During this initial time period, the torque signal is monitored to detect cyclic signals. After the initial time period but before the expected exposure time a filter can be configured and applied to block the cyclic noise detected during the initial time period.

Implementations and all of the functional operations described in this specification, e.g., of the controller 190, can be implemented in digital electronic circuitry, or in computer software, firmware, or hardware, including the structural means disclosed in this specification and structural equivalents thereof, or in combinations of them. Implementations described herein can be implemented as one or more non-transitory computer program products, i.e., one or more computer programs tangibly embodied in a machine readable storage device, for execution by, or to control the operation of, data processing apparatus, e.g., a programmable processor, a computer, or multiple processors or computers.

A computer program (also known as a program, software, software application, or code) can be written in any form of programming language, including compiled or interpreted languages, and it can be deployed in any form, including as a stand alone program or as a module, component, subroutine, or other unit suitable for use in a computing environment. A computer program does not necessarily correspond to a file. A program can be stored in a portion of a file that holds other programs or data, in a single file dedicated to the program in question, or in multiple coordinated files (e.g., files that store one or more modules, sub programs, or portions of code). A computer program can be deployed to be executed on one computer or on multiple computers at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit).

The term "data processing apparatus" encompasses all apparatus, devices, and machines for processing data, including by way of example a programmable processor, a computer, or multiple processors or computers. The apparatus can include, in addition to hardware, code that creates an execution environment for the computer program in question, e.g., code that constitutes processor firmware, a protocol stack, a database management system, an operating system, or a combination of one or more of them. Processors suitable for the execution of a computer program include, by way of example, both general and special purpose microprocessors, and any one or more processors of any kind of digital computer.

Computer readable media suitable for storing computer program instructions and data include all forms of non volatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

The above described polishing apparatus and methods can be applied in a variety of polishing systems. Either the polishing pad, or the carrier head, or both can move to provide relative motion between the polishing surface and the wafer. For example, the platen may orbit rather than rotate. The polishing pad can be a circular (or some other shape) pad secured to the platen. Some aspects of the endpoint detection system may be applicable to linear polishing systems (e.g., where the polishing pad is a continuous or a reel-to-reel belt that moves linearly). The polishing layer can be a standard (for example, polyurethane with or without fillers) polishing material, a soft material, or a fixed-abrasive material. Terms of relative positioning are used; it should be understood that the polishing surface and wafer can be held in a vertical orientation or some other orientations.

While this specification contains many specifics, these should not be construed as limitations on the scope of what may be claimed, but rather as descriptions of features that may be specific to particular embodiments of particular inventions. In some implementations, the method could be applied to other combinations of overlying and underlying materials.

What is claimed is:

1. A method of polishing, comprising:

bringing a substrate into contact with a polishing pad that has a polishing surface and a region of different coefficient of friction than the polishing surface, wherein the substrate has an overlying layer and an underlying layer;

generating relative motion between the substrate and polishing pad such that the region of different coefficient of friction moves across the substrate;

during polishing of the substrate, monitoring the substrate with an in-situ monitoring system to measure a motor torque and generate a sequence of measured values;

calculating positions on the substrate of the region of different coefficient of friction for at least two measured values from the sequence of measured values, comparing a first measured value from the sequence of measured values at which the region of different coefficient of friction is at a first position in a first zone on the substrate to a second measured value from the sequence of measured values at which the region of different coefficient of friction is at a second position in a different second zone on the substrate or is not below the substrate;

based on comparing the first measured value and the second measured value, determining in which of the first zone or the different second zone the overlying layer is clearing first to expose the underlying layer; and adjusting a polishing parameter based on which of the first zone or the different second zone is clearing first.

2. The method of claim 1, wherein the in-situ monitoring system comprises a strain gauge to measure frictional force on a carrier head, or a current sensor to monitor a current supplied to a motor configured to control at least one of the carrier head or a platen.

3. The method of claim 1, wherein the region has a lower coefficient of friction than the polishing surface.

4. The method of claim 3, wherein the region comprises an aperture or recess in the polishing pad.

5. The method of claim 3, wherein the polishing surface comprises a first material and the region comprises a second material of different composition.

6. The method of claim 1, wherein the polishing surface comprises a first plurality of grooves having a first width or pitch and the region comprises a second plurality of grooves having different second width or pitch.

7. The method of claim 1, wherein the first zone comprises a center region of the substrate and the different second zone comprises an edge region of the substrate.

8. The method of claim 1, wherein the second measured value is at a second position in a different second zone on the substrate.

9. The method of claim 1, wherein the second measured value corresponds to the region of different coefficient of friction being at the second position in the different second zone on the substrate.

10. The method of claim 1, wherein the second measured value corresponds to the region of different coefficient of friction being not below the substrate.

11. A computer program product, comprising a non-transitory computer-readable medium having instructions, which, when executed by a processor of a polishing system, causes the polishing system to:

receive during polishing of a substrate a sequence of measured values from an in-situ monitoring system to measure a motor torque;

for at least one measured value from the sequence of measured values, calculate a position on the substrate of a region of different coefficient of friction;

compare a first measured value from the sequence of measured values at which the region of different coefficient of friction is at a first position in a first zone on the substrate to a second measured value from the sequence of measured values at which the region of different coefficient of friction is at a second position in a different second zone on the substrate or is not below the substrate;

based on the comparison of the first measured value and the second measured value, determine in which of the first zone or the different second zone an overlying layer is clearing first to expose an underlying layer; and adjust a pressure of a carrier head based on which of the first zone or the different second zone is clearing first.

12. The computer program product of claim 11, comprising instructions to store one or more parameters indicating a relative coefficient of friction of the overlying layer and the underlying layer.

13. The computer program product of claim 12, wherein the instructions to store the one or more parameters comprise instructions to store a single parameter indicating which of the overlying layer and the underlying layer has a higher coefficient of friction.

14. The computer program product of claim 12, wherein the instructions to store the one or more parameters comprise instructions to store a first parameter indicating a coefficient of friction of the overlying layer and a second parameter indicating a coefficient of friction of the underlying layer.

15. The computer program product of claim 12, wherein the one or more parameters indicate that the underlying layer has a higher coefficient of friction, and comprising instructions to determine that the first zone is clearing before the different second zone based on the first measured value being lower than the second measured value.

16. The computer program product of claim 12, wherein the one or more parameters indicate that the underlying layer has a lower coefficient of friction, and comprising instructions to determine that the first zone is clearing before the different second zone based on the first measured value being higher than the second measured value.

17. The computer program product of claim 12, wherein the one or more parameters indicate that the underlying layer has a lower coefficient of friction, and comprising instructions to determine that the first zone is clearing after the different second zone based on the first measured value being higher than the second measured value.

18. The computer program product of claim 12, wherein the one or more parameters indicate that the underlying layer has a higher coefficient of friction, and comprising instructions to determine that the first zone is clearing before the different second zone based on the first measured value being lower than the second measured value.

19. A polishing system, comprising:

a platen to support a polishing pad;

a carrier head to hold a substrate against the polishing pad;

a motor to generate relative motion between the carrier head and the platen;

an in-situ monitoring system to measure a motor torque and generate a sequence of measured values representative of torque of the motor;

a sensor to detect a position of a region of the polishing pad;

a controller configured to:

receive the sequence of measured values from the in-situ monitoring system, for at least one measured value from the sequence of measured values, calculate based on data from the sensor a position on the substrate of the region of different coefficient of friction;

compare a first measured value from the sequence of measured values at which the region is at a first position in a first zone on the substrate to a second measured value from the sequence of measured values at which the region is at a second position in a different second zone on the substrate or is not below the substrate;

based on comparing the first measured value and the second measured value, determine in which of the first zone or the different second zone is clearing first to expose an underlying layer; and adjust a polishing parameter based on which of the first zone or the different second zone is clearing first.

* * * * *